United States Patent [19]

Kagamiyama

[11] 4,451,214

[45] May 29, 1984

[54] ROTARY PISTON TYPE FLUID MACHINE

[76] Inventor: Rokuro Kagamiyama, 1069-181, Tsu, City of Kamakura, Kanagawa Prefecture, Japan

[21] Appl. No.: 418,743

[22] Filed: Sep. 16, 1982

Related U.S. Application Data

[62] Division of Ser. No. 157,394, Jun. 9, 1980, abandoned.

[51] Int. Cl.[3] ..... F04C 23/00; F04C 27/00

[52] U.S. Cl. ..... 418/11; 418/12; 418/139; 418/143; 418/211; 418/212; 418/214; 418/245; 418/247

[58] Field of Search ..... 418/210, 214, 245, 247, 418/11, 12, 212, 143, 211

[56] References Cited

U.S. PATENT DOCUMENTS

| | | | |
|---|---|---|---|
| 896,368 | 8/1908 | Ferguson | 418/245 |
| 935,489 | 9/1909 | Garrabrant et al. | 418/245 |
| 1,980,858 | 11/1934 | Glenn | 418/245 |
| 2,717,555 | 9/1955 | Hinckley | 418/212 |
| 3,617,158 | 11/1971 | Yamamoto et al. | 418/11 |
| 3,897,758 | 8/1975 | Humiston et al. | 418/245 |

*Primary Examiner*—John J. Vrablik

[57] ABSTRACT

A rotary piston type fluid machine comprises one or more rotary piston type fluid machine units, each comprising a doughnut type ring-shaped cylinder with an annular slit being provided in the wall at the inward periphery lying in a plane containing the annular central line of the cylinder, a rotor rotatively supported by the cylinder with the peripheral portion being shiftably received within the slit, one or more rotary pistons secured to the peripheral surface of the rotor and adapted to be shifted within the cylinder, and one or more gate valves mounted to the cylinder so as to cross the cylinder and adapted to periodically protrude into the cylinder in synchronization with the movement of the rotary pistons. The rotary piston type fluid machine unit can be utilized as a compressor, an internal combustion engine, a pump, etc. by using it singly, or as a number of the units in combination.

7 Claims, 32 Drawing Figures

FIG. 6a
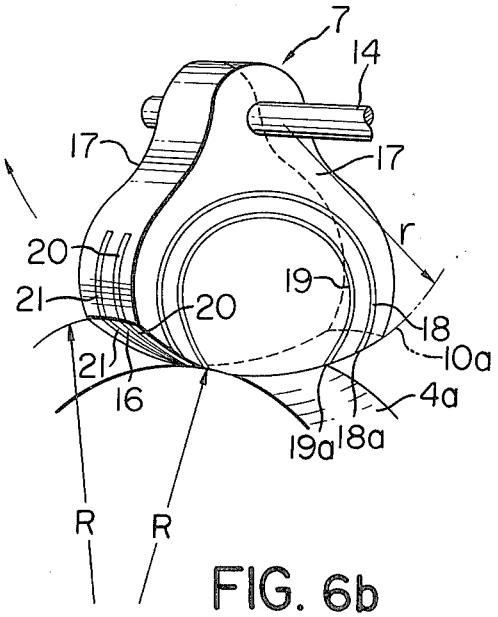
FIG. 6b
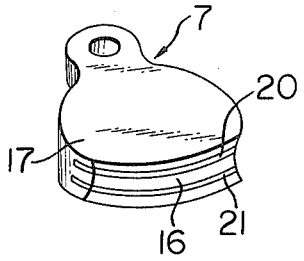
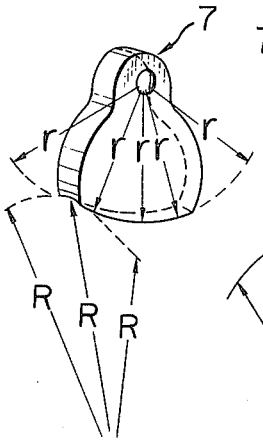
FIG. 6c
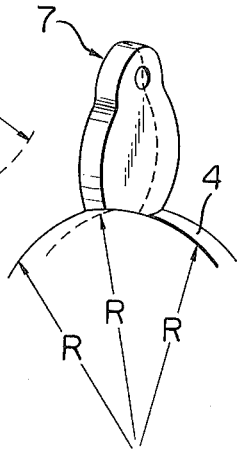
FIG. 6d
FIG. 7
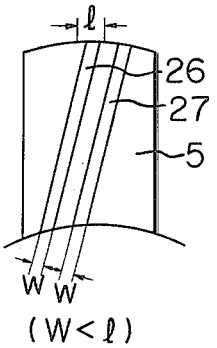
FIG. 8
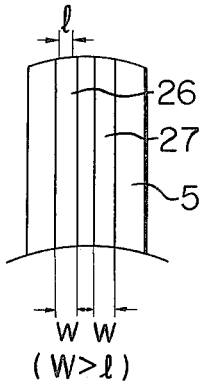
FIG. 9
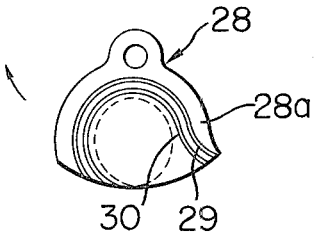

ROTARY PISTON TYPE FLUID MACHINE

This is a division, of application Ser. No. 157,394, filed June 9, 1980, abandoned.

BACKGROUND OF THE INVENTION

The present invention relates to a fluid machine and more particularly to a fluid machine provided with rotary type pistons and applicable to internal combustion engines, compressors, pumps, etc.

In the hitherto known reciprocating type internal combustion engines such as diesel engines and gasoline engines the reciprocating movement derived from the power generating parts is transformed into a rotational movement through a crank mechanism. Therefore, they not only lose a considerable amount of power during the transformation, but also due to the need for space to mount the crank mechanism, there are such drawbacks as a largeness in dimensions, considerable weight, and large number of parts, as well as a failing in that the cylinder spaces on both sides of the piston are not effectively utilized simultaneously.

On the other hand, a rotary piston type internal combustion engine known as a "Wankel-engine" has recently been rendered practicable, but, in this engine, since the rubbing surfaces of the rotary piston and the cylinder are epitrochoidal curved surfaces the accuracy of machining of the rubbing surfaces needs to be of an extremely high order, and technology of a high order is also required in connection with the pressure seal and the lubrication of the rubbing surfaces. Further, the fuel consumption as represented by the ratio of the fuel quantity with the output power of the "Wankel-engine" is not better than that of the conventional reciprocating engine.

SUMMARY OF THE INVENTION

It is a primary object of the present invention to provide a rotary piston type fluid machine in which there is substantially no waste on transmitting power thereto or deriving power therefrom.

It is an other object of the present invention to provide a rotary piston type fluid machine which is low in weight, small in dimensions, and has only a small number of parts.

It is a further object of the present invention to provide a rotary piston type fluid machine which is easily applicable to internal combustion engines, compressors, pumps, etc.

It is still a further object of the present invention to provide a rotary piston type fluid machine which is applicable to an internal combustion engine or a compressor in which the total thermodynamic performance is higher than that of the conventional reciprocating internal combustion engine or compressor.

In accordance with the present invention a rotary piston type fluid machine is provided which comprises one or more rotary piston type fluid machine units, each having a doughnut type ring-shaped cylinder with an annular slit being formed in the inner circular wall, a rotor disposed centrally of the cylinder with its outer periphery being sealingly and shiftably disposed within the annular slit, one or more rotary pistons secured to the outer periphery surface of the rotor and adapted to be shifted within the cylinder, and one or more gate valves provided within the cylinder and adapted to close and open the interior of the cylinder such that one or more cylinder chambers are formed between them and the rotary pistons shifting towards them when the gate valves are closed to shut off the cylinder interior, whereby the gate valves are actuated in synchronization with the rotary movement of the rotary pistons.

An internal combustion engine or a compressor or a pump can be easily provided according to the present invention by utilizing one or more of the rotary piston type fluid machine units singly, or in combination, and, if required, in association with a compressed air or gas accumulating reservoir.

In accordance with one aspect of the present invention an internal combustion engine is provided by utilizing one or more rotary piston type fluid machine units as expanders of internal combustion engines and a further one or more rotary piston type fluid machine units as air compressors which have a higher thermodynamic performance since the performances of each of the expanders and the compressors can be selected to be adequate and independent from each other so that the total performance of these combined units is made optimum.

In accordance with another aspect of the present invention a gas compressor is provided by utilizing two or more of the rotary piston type fluid machine units wherein all of them are driven by a common power transmission shaft with specific phase differences being established between the respective units. For example, in the case of a gas compressor comprising two rotary piston type fluid machine units a relative process phase difference of 90° is established therebetween such that the residual compressed gas left at the state just before the final stage of the compression cycle in the cylinder chamber of one unit is supplied through the opened gas transfer valve into the cylinder chamber of the other unit which is at an intermediate stage of the compression cycle, whereby the residual compressed gas at a higher pressure in the first unit is recovered into the second unit, and when each compressor proceeds to rotate through 90° beyond the above position, the same effects as above are achieved alternately between the two units, whereby the operational cycle is repeated, so the total thermodynamic performance is considerably improved.

BRIEF DESCRIPTION OF THE DRAWINGS

Other objects and advantages of this invention will become apparent from the following description taken in connection with the accompanying drawings wherein are set forth by way of illustration and example certain embodiments of this invention.

FIG. 6(*a*) and (*b*) are perspective views of the rotary gate valve shown in FIGS. 2, 3 and 4 as viewed from different directions;

FIGS. 6(*c*) and (*d*) are perspective views of the rotary gate valve to explain its shape as viewed from different directions;

FIGS. 7 and 8 are side elevational views showing two embodiments of the rotary pistons shown in FIG. 4;

FIG. 9 is a front elevational view of another embodiment of the rotary gate valve shown in FIG. 6;

FIGS. 10(*b*) and 10(*c*) are perspective views showing the shape of the gate valve shown in FIG. 10(*a*) in two different positions;

DESCRIPTION OF THE PREFERRED EMBODIMENTS

Figure 1:
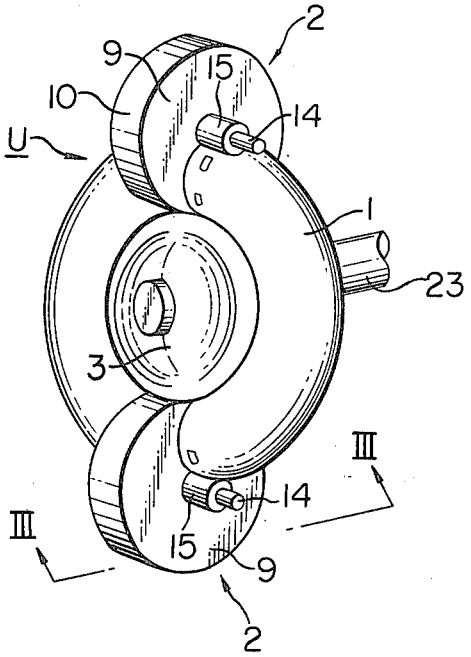
FIG. 1 is a perspective view of one embodiment of a rotary piston type fluid machine unit constituting the rotary piston type fluid machine according to the present invention.
Figure 2:
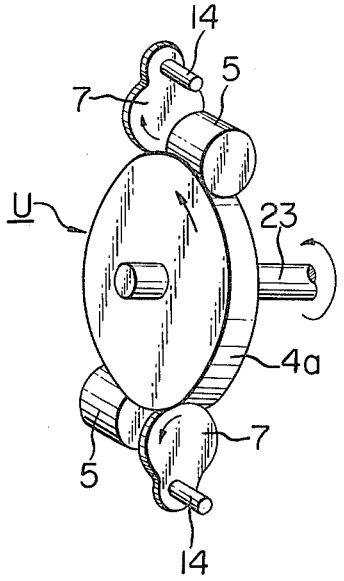
FIG. 2 is a perspective view showing the internal constructional elements of the unit shown in FIG. 1.

Referring now to FIGS. 1 to 4 of the attached drawings there is shown one embodiment of a fluid machine unit U which constitutes the rotary piston type fluid machine according to the present invention by itself or with a number of them being properly combined. Fluid machine unit U comprises a doughnut type ring-shaped annular cylinder 1 having an annular cylinder chamber 6 of a circular cross-section with an annular slit being left in the wall radially at the inward periphery so as to be in synmmetrical relationship with the plane containing the annular central line of the annular cylinder, valve casings 2, 2 fixedly secured to cylinder 1 radially so as to cross it substantially at equiangular intervals, cover plates 3 rigidly secured to the outer wall of cylinder 1 on its inner periphery so as to confront each other with a gap corresponding to the annular slit of cylinder 1 being left at least on the peripheral portions, a rotor 4 rotatably mounted within the space formed by confronting covers 3 and having a circular disc shape with its peripheral portion being slidably received within the slit of cylinder 1 as well as the gap between confronting covers 3, rotary pistons 5, 5 fixedly mounted to the peripheral surface 4*a* of rotor 4 and adapted to shift within cylinder chamber 6 of cylinder 1 together with rotor 4, and rotary gate valves 7, 7 each being calabash shaped and contained within gate valve casings 2, respectively, such that they rotate in synchronization with the movement of rotary pistons 5 so as to close and open cylinder chambers 6 formed within cylinder 1, for predetermined periods of time, respectively.

Each of gate valve casings 2 is shaped so as to reveal a flat cylindrical chamber and comprises circular side plates 9 disposed oppositely, spaced apart, and a peripheral wall 10 interconnecting the outer peripheries of side plates 9 so as to form a rotary gate valve receiving chamber 8 therein.

A portion of each of side plates 9 is introduced into cylinder chamber 6 across cylinder 1 such that the innermost portions of side plates 9 reach peripheral surface 4*a* of rotor 4, a circular opening 11 having the same diameter as the inner diameter of cylinder chamber 6 being formed in the introduced portion so as to allow piston 5 to pass through it, and cylinder chambers 6 and rotary gate valve receiving chambers 8 are made to be in communication with each other when rotary gate valve 7 opens circular openings 11.

In the case where fluid machine unit U is to be used as a compressor cylinder chambers 6 are provided with suction ports 12 and discharge ports 13, formed in the wall of cylinder 1 near circular openings 11 of rotary gate valve receiving chamber 8. Further, in the case where fluid machine unit U is to be used as an expander of an internal combustion engine to be fully described later, cylinder chambers 6 are additionally provided with scavenging ports 13*a* for scavenging the exhaust gas left within cylinder chambers 6. Suction ports 12, discharge ports 13 and scavenging ports 13*a* are respectively provided with any conventional valve mechanisms (not shown) as publicly known in the field of the art per se.

Rotary gate valve 7 is adapted to be rotated within rotary gate valve receiving chamber 8 about a gate valve shaft 14 which is supported by bearing means 15 formed in side plates 9 of rotary gate valve receiving chamber 8 near the intersecting part of side plates 9 with cylinder 1, and one end of gate valve shaft 14 is elongated outwards through bearing means 15 to be operatively connected to a timed actuating mechanism to operate rotary gate valve 7 in synchronization with the rotation of pistons 5.

Figure 5:
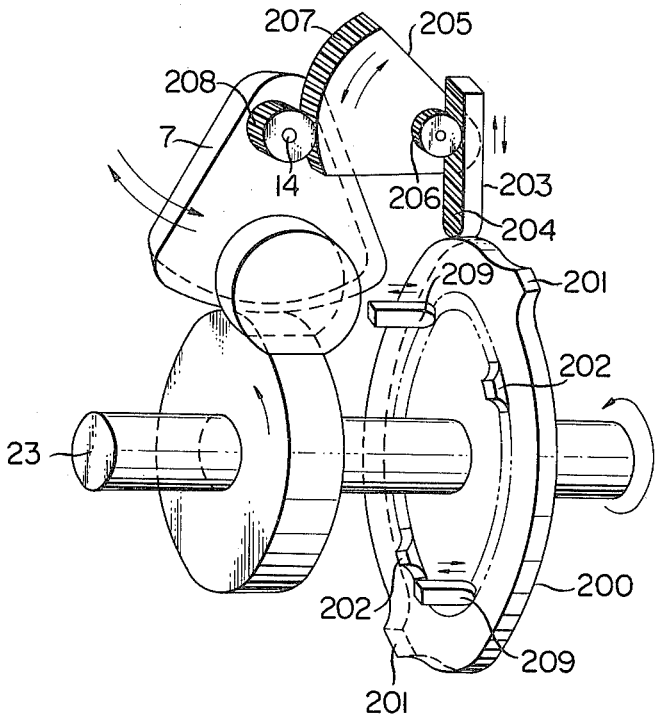
FIG. 5 is a schematical view of one example of the actuating mechanism to operate the rotary gate valve in synchronization with the rotation of rotary piston shown in FIGS. 2 and 3.

A preferred embodiment of the timed actuating mechanism is schematically shown in FIG. 5 although it is not limited thereto. As shown in the drawing, fixedly secured to power transmission shaft 23 is a timing cam disc 200 which has a generally circular disc configuration with a number of timing cams 201 for gate valves 7 being protruded from its outer periphery and a number of timing cams 202 for other valves i.e. suction, discharge, transfer and scavenging valves etc. as required being protruded from one or both side surfaces thereof so as to be arranged in one or more circles, whereby the number of timing cams 201 for gate valves 7 corresponds to that of rotary pistons 5. As to timing cams 201 for gate valves 7 a number of timing sticks 203 are associated therewith so as to be reciprocated when timing cam disc 200 rotates together with power transmission shaft 23. Timing stick 203 is provided with teeth 204 on its own face. An intermediary timing gear disc 205 rotatively supported on the unit frame is in mesh with teeth 204 by means of a pinion 206 secured coaxially with disc 205, disc 205 having its outer periphery formed with a sector gear 207 which is in mesh with a pinion 208 fixedly secured to gate valve 7 on gate valve shaft 14. Thus, it will be appreciated that gate valve 7 is actuated by the rotation of timing cam disc 200 through timing cams 201 via timing stick 203, teeth 204, intermediary timing gear disc 205, pinion 206, sector gear 207 and pinion 208.

Timing cams 202 for other valves are intended to actuate suction, discharge, transfer, and scavenging valves, etc. to be described later in connection with the application of the fluid machine units according to the present invention as compressors, internal combustion engines, pumps, etc. In this case, timing cams 202 may actuate the various valves through a number of bars 209 directly or indirectly through the intermediary of suitable lever mechanisms.

Rotary gate valve 7 comprises, as shown in FIGS. 6*a, b, c* and *d,* a first rubbing surface 16 to run over peripheral surface 4*a* of rotor 4 and second rubbing surfaces 17 to run over the inner surfaces 9*a* of side plates 9 of gate valve casing 2. First rubbing surface 16 is provided with a pressure sealing ring member 20 and an oil retaining ring member 21, respectively, performing the pressure sealing and lubricating actions between rotary gate valve 7 and peripheral surface 4*a* of rotor 4. The first rubbing surface 16 has a curved surface comprising the combination of a cylindrical surface conforming to that of peripheral surface 4*a* of rotor 4 and a cylindrical surface conforming to the outer peripheries of the confronting side surfaces of rotary gate valve 7, whereby peripheral surface 4*a* of rotor 4 is shaped concavely so as to have a radius r of the outer peripheries of the confronting surfaces of rotary gate valve 7 centered at gate valve shaft 14 (See FIG. 6*c*), and at the same time first rubbing surface 16 of rotary gate valve 7 is also shaped concavely so as to have a radius R of rotor 4 centered at the center of rotor 4 (See FIG. 6*d*). Thus, first rubbing surface 16 of rotary gate valve 7 assures excellent sealing of the rubbing surface against peripheral surface 4*a* of rotor 4 and rotary gate valve 7 in association with pressure sealing ring member 20 and oil retaining ring member 21.

Second rubbing surfaces 17 of rotary gate valve 7 are respectively provided with an oil retaining ring member 18 and a pressure sealing ring member 19, each having substantially a circular ring shape with a portion facing peripheral surface 4*a* of rotor 4 being cut away.

Figure 4:
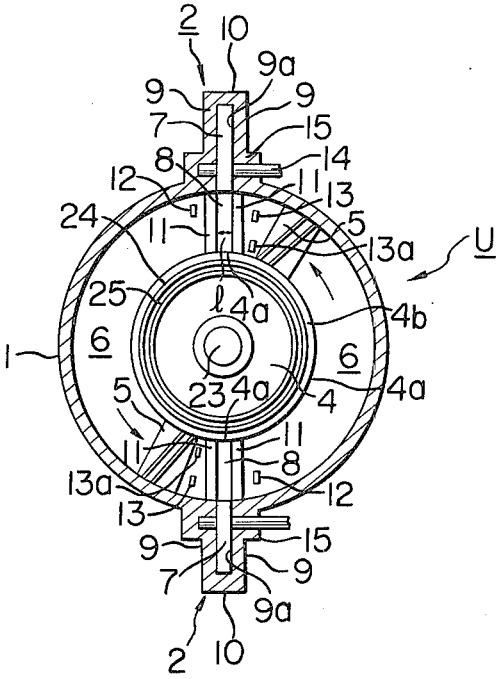
FIG. 4 is a cross-sectional view taken along the line IV—IV of FIG. 3.

As shown in FIG. 4 rotor 4 mounts on a drive shaft 23 at its center which is rotatably journaled in bearing members 3*a* provided in cover plates 3, and one end of shaft 23 projects outwards through bearing member 3*a* to have power transmitted thereto or taken therefrom as the case may be. Cover plate 3 has sufficient mechanical rigidity and is fixedly connected to the inner wall of cylinder 1 so as to lie in symmetry with the plane containing the annular center line of cylinder 1, and confronting cover plates 3 have their peripheral annular portions spaced apart in parallel with each other so as to shiftably receive the outer peripheral annular portion of rotor 4 therebetween, the inner surfaces of the peripheral annular portions of either cover plates 3 or rotor 4, or both are provided with pressure sealing ring means 24 and oil retaining ring means 25 for the purpose of assuring the sealing and lubrication between them.

As shown in FIGS. 7 and 8, rotary piston 5 has a shape whereby a cylinder has its inner surface curved so as to conform to the radius of curvature of the annular shape of cylinder chamber 6 of cylinder 1 so that it is smoothly shiftable within cylinder chamber 6, i.e. a shape obtained by cutting a doughnut shaped ring to have a desired height. The periphery of piston 5 is provided with a pressure sealing ring means 26 and an oil retaining ring means 27. In this case, as shown in FIG. 7, when the thickness w of ring means 26 or 27 is less than the width l of the gap between the inner surfaces of side plates 9 of rotary gate valve receiving chamber 8 measured in the direction of movement of rotary piston 5 (See FIG. 4), they are mounted obliquely relative to the radial direction of rotor 4 so as to pass through the gap without obstruction. And, as shown in FIG. 8, when thickness w is larger than width l the ring means are mounted in parallel with the radial direction. By so constituting piston ring means 26, 27 they can be effectively prevented from jumping into rotary gate valve receiving chamber 8 of valve casing 2 when piston 5 passes over the gap of rotary gate valve receiving chamber 8.

In order that when rotary gate valve 7 rotates clockwise as viewed in FIG. 6*a* to open circular openings 11 formed in side plates 9 of gate valve casing 2 after it has closed openings 11, the trailing ends 18*a* and 19*a* of oil retaining ring means 18 and pressure sealing ring means 19 provided in second rubbing surfaces 17 of rotary gate valve 7 are not caught on the peripheral edges of circular openings 11 of side plates 9 of gate valve casing 2, trailing end 28*a* of rotary gate valve 28 may be, as shown in FIG. 9, elongated in a direction opposite to the direction of rotation so that the trailing ends of oil retaining ring means 29 and pressure sealing ring means 30 can be similarly elongated in that direction.

Figure 10A:
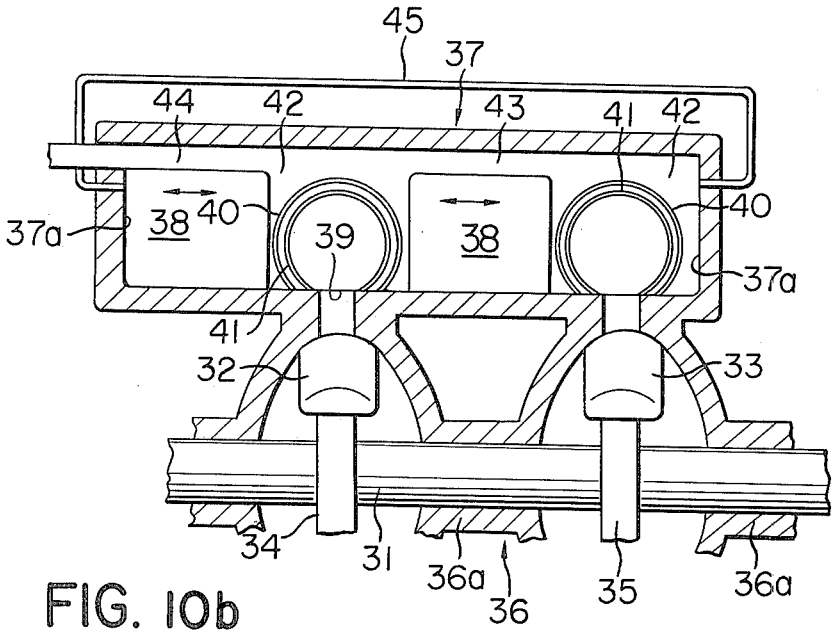
FIG. 10(*a*) is a longitudinal sectional view of a modification of the gate valve shown in FIG. 6 in which a pair of reciprocating type gate valves are prepared for two rotary piston type fluid machine units arranged in a side-by-side relationship.

FIGS. 10*a, b* and *c* show an alternative constitution for gate valve 7 as described above, wherein the gate valve is, as shown applied to a fluid machine according to the present invention in which two of the fluid machine units, each having a substantially similar constitution to that shown in FIGS. 1 to 4 except that the gate valves are used in combination and embodied as a reciprocating type gate valve, are used in side-by-side relationship.

As shown, mounted on a common driving shaft 31 and spaced apart are two rotors 34, 35 having pistons 32, 33, respectively, driving shaft 31 being rotatably received within bearing members 36*a* formed in cover plates 36, and a reciprocating type gate valve casing 37 having a generally rectangular cross-section is mounted to the outer peripheral parts of cover plates 36 so as to bridge the gaps each formed by confronting cover plates 36 for both rotors 34, 35, respectively.

Formed within gate valve casing 37 is a gate valve receiving chamber 38 having a generally rectangular cross-section within which is shiftably mounted a pair of plate-shaped reciprocating type gate valves 42 so as to be reciprocated relative to the inner side walls as well as the bottom surface of chamber 38, whereby on the shifting surfaces of gate valve 42 are provided suitable oil retaining ring means 40 and 41*a* and pressure sealing means 41 and 40*a,* respectively. The two gate valves 42 are connected together by a connecting member 43 with a sufficient space being left therebetween so that when they are shifted in one or other direction the cylinder chambers are closed or opened simultaneously, and a rod member 44 secured to connecting member 43 projects outwardly through gate valve casing 37 to cause them to reciprocate by a timed actuating mechanism similar to that shown in FIG. 5 although not limited thereto, i.e. rod member 44 is provided with teeth on its own surface being in mesh with the sector gear 207 of intermediary timing gear disc 205, whereby the rod member 44 is reciprocated periodically and alternately, the rod member 44 is actuated directly by the bar 29 or indirectly through the intermediary of suitable lever mechanisms, whereby the rod member 44 is reciprocated periodically.

Figure 11:
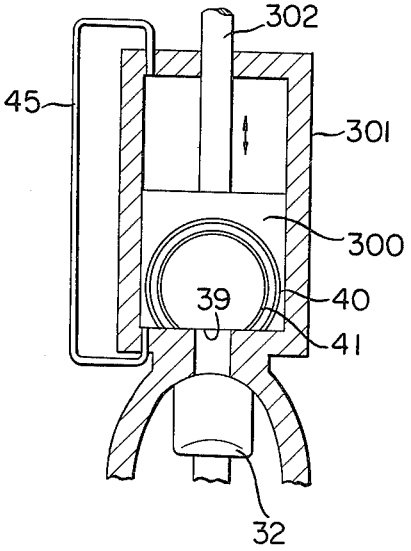
FIG. 11 is a schematic view of an alternative constitution of the gate valve shown in FIG. 10(*a*)

Alternatively, the gate valve may be reciprocated independently for the resepctive fluid machine units. FIG. 11 shows schematically one example of such a gate valve. As shown in FIG. 11 a rectangular gate valve 300 is shiftably mounted within a valve casing 301 having a similar configuration, gate valve 300 being adapted to be moved radially within valve casing 301 by operating a valve stem 302 fixedly secured to valve 300 through any suitable actuating means. Thus, it will be appreciated that when the respective cylinders are provided with a necessary number of gate valves 300 for respective valve casings 301 and they are adapted to be actuated independently among the respective fluid machine units, an overall optimum performance will be obtained by selecting a suitable timing between them.

In order to reduce the resistance due to compression or expansion of gas contained within gate valve receiving chamber 38 caused when gate valves 42 are suddenly rapidly reciprocated, both ends of gate valve receiving chamber 38 are connected by a gas pressure equalizing conduit 45.

The shape of rubbing surfaces 39 of gate valves 42 to be shifted relative to the peripheral surfaces of rotors 34, 35 is a cylindrical curved surface having a radius R of rotors 34, 35 centered at driving shaft 31 so that it is concave so as to conform to this curved surface. See FIG. 10(*b*). Rubbing surface 39 is provided with a pressure sealing bar-like member 40*a* and an oil lubricating seal bar-like member 41*a* as shown in FIGS. 10(*c*).

Figure 3:
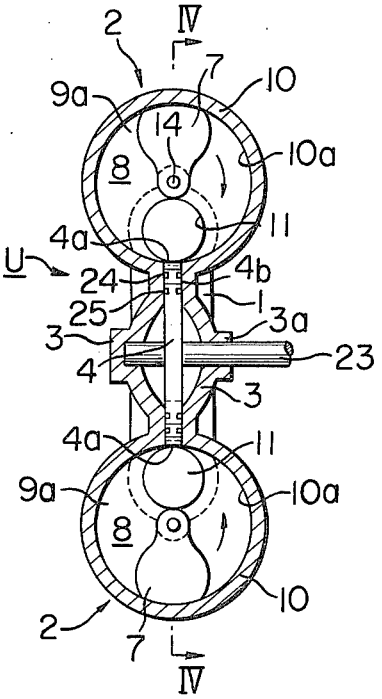
FIG. 3 is a cross-sectional view taken along the line III—III of FIG. 1.
Figure 12:
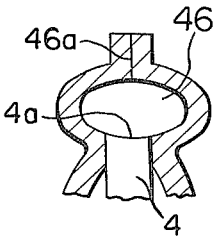
FIGS. 12 and 13 are cross-sectional views showing two different cross-sections of the cylinder shown in FIG. 3.
Figure 13:
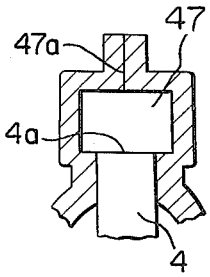

Although in the embodiments the cross-section of the cylinder chamber has been shown as being circular as shown at 11 in FIG. 3, it is not limited to being circular, instead it may be, if required, elliptical as shown at 46 in FIG. 12, or rectangular as shown at 47 in FIG. 13, or the like. In a case where the piston rings are obliquely mounted to the piston as shown in FIG. 7, if the cylinder chamber and the rotary pistons have an elliptical cross-section, the piston rings may have a true circular shape.

Figure 10B:
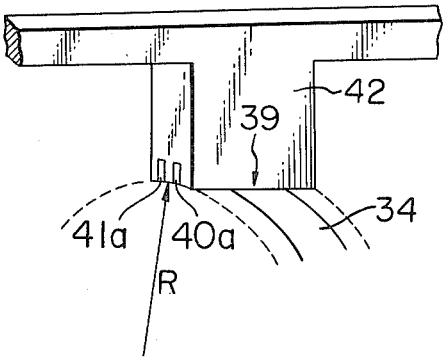
Figure 10C:
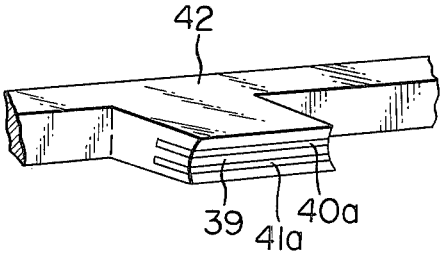

Although, in FIG. 10, the reciprocating type gate valve is shown as working integrally with both rotors 34, 35 by bridging them, it is possible to provide a calabash shaped rotary type gate valve independently for each of the fluid machine units driven by the same drive shaft. In this case, since the relative phase angles between the mounting positions of the rotary gate valves for a number of ringshaped cylinders may be selected at will, the selection of the mounting positions of the gate valves appropriate to the specific purpose at hand is possible.

At this point, it will be appreciated that the manufacture of the annular cylinder of the fluid machine unit according to the present invention will be facilitated when the cylinder is so constituted that two substantially symmetric halves as obtained by bisecting the cylinder with a plane containing the annular center line of the cylinder are fixedly connected together at the confronting diametrical planes as shown at 46*a* and 47*a* in FIGS. 12 and 13, or other planes as required (not shown).

Now the operation of the rotary piston type fluid machine unit, the constitution of which has been so far described, will be explained in conjunction with certain embodiments of the rotary piston type fluid machine comprising one or more units according to the present invention. Although the rotary piston type fluid machine according to the present invention can be realized as an internal combustion engine, a compressor, a pump, etc. by using a fluid machine unit so far explained singly, the following is an explanation of two examples as obtainable by the use of two units.

Figure 14:
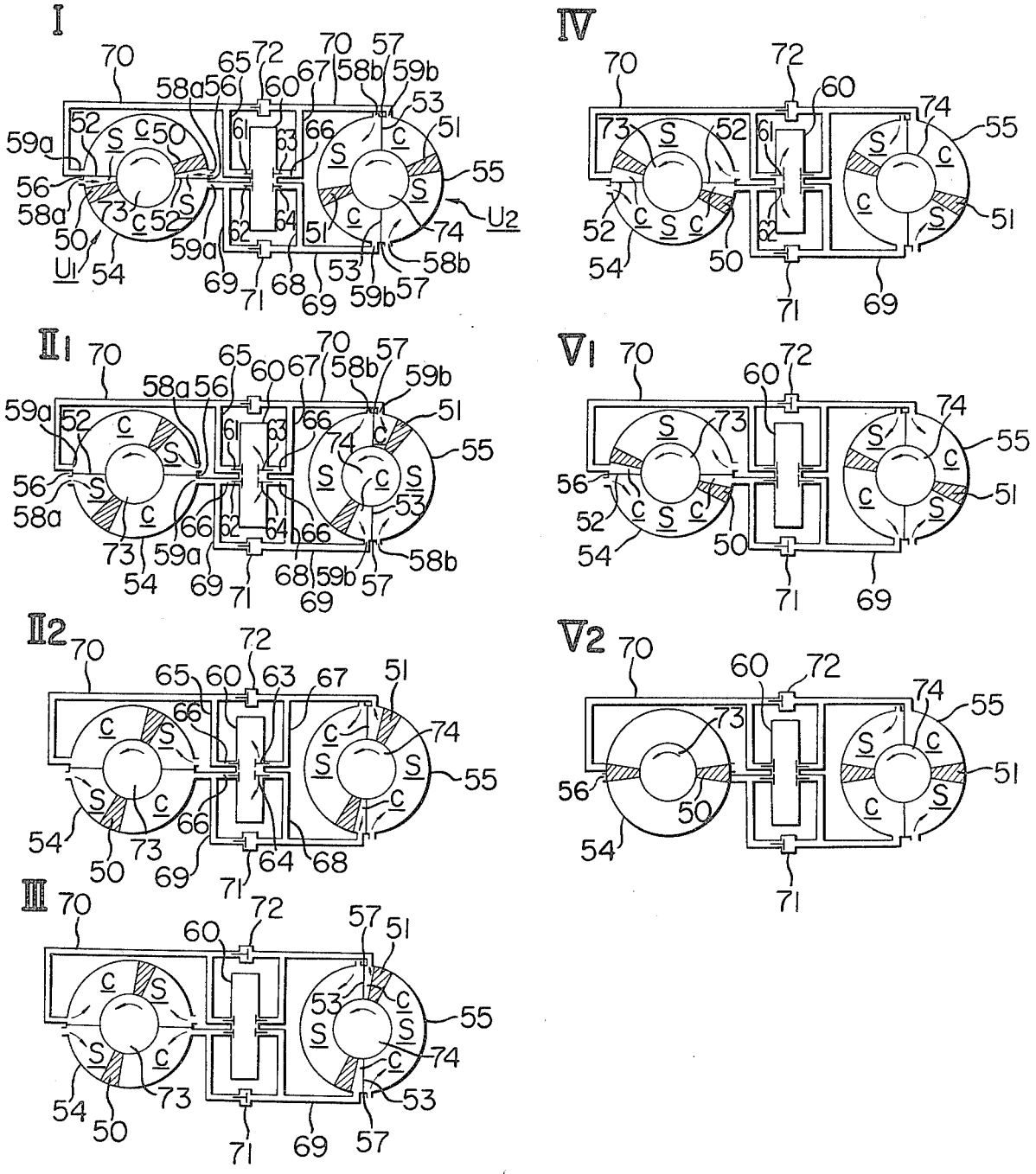
FIG. 14 (I, II1, II2, III, IV, VI, V2) consists of sequential diagrams to show one complete operational cycle of a compressor comprising two fluid machine units as shown in FIGS. 1 to 4.

FIG. 14(I) to ($V_2$) are sequential diagrams showing one operational cycle of a compressor comprising two units $U_1$ and $U_2$ combined together, that is, the first unit $U_1$ and the second unit $U_2$ are arranged on a common rotor shaft to be driven in parallel, the relative phase angles of pistons 50, 51 of both units $U_1$, $U_2$ being shifted by a predetermined adequate angle, e.g. 90° when each unit $U_1$ and $U_2$ has two gate valves and two rotary pistons as exemplified in FIG. 14, on the basis of the gate valves. Therefore, the timing of the opening and closing of gate valves 52, 53 of two units $U_1$ and $U_2$ are not identical, i.e. the timing of gate valve 52 has a lag of 90° behind that of gate valve 53. Suction ports 58*a*, 58*b* and discharge ports 59*a*, 59*b* are provided respectively near gate valve casings 56, 57 of first cylinder 54 and second cylinder 55 of combined units $U_1$ and $U_2$. A compressed gas accumulating reservoir 60 is connected to discharge ports 59*a*, 59*b* of two cylinders 54, 55 through conduits 65, 66, 67, 68, 69 and 70, whereby reservoir 60 is adapted to be controlled by four valves 61, 62, 63 and 64. Provided in conduits 69 and 70 at their intermediate portions are compressed gas transfer valves 71 and 72, respectively.

In FIG. 14(I), pistons 50 of first cylinder 54 are at positions directly after they have passed the opening port of valve casing 56, i.e. at the start positions of the compression cycle, while pistons 51 of second cylinder 55 are at intermediate positions of the compression cycle. At this point it should be noted that rotors 73, 74 of the two units $U_1$ and $U_2$ are assumed to be rotated counterclockwise. At this time gate valves 52, 53 of the two cylinders are closed, and in the drawings other than FIG. 14($V_2$) gate valves 52, 53 are all shown as being closed.

Both cylinders 54, 55 shown in FIG. 14(I) suck gases into their cylinder suction chambers S through suction ports 58*a*, 58*b*, and in compression chambers C formed within cylinders 54, 55 between gate valves 52, 53 and pistons 50, 51 rotating towards gate valves 52, 53 the compression of gases takes place, whereas in suction chambers S formed within cylinders 54, 55 between the rear ends against the rotating direction of pistons 50, 51 and gate valves 52, 53 new gases are sucked through suction ports 58*a*, 58*b*. In this state gas discharge valves 61, 62, 63, 64 connected to compressed gas accumulation reservoir 60 and gas transfer valves 71, 72 in conduits 69, 70 are all closed.

Upon further counterclockwise rotation of piston 50, 51 from this condition shown in FIG. 14(I) to the positions shown in FIG. 14($II_2$) through FIG. 14($II_1$), the gases within compression chambers C of second cylinder 55 are compressed above a predetermined pressure, and discharge valves 63, 64 connected to compressed gas accumulating reservoir 60 at the side of second cylinder 55 are operated to discharge the compressed gas into reservoir 60. At this time first cylinder 54 is at an intermediate stage of the compression cycle and the valves other than those, 63, 64, connected to compressed gas accumulating reservoir 60 are all closed.

At the final stage of the compression cycle of the second cylinder 55, i.e. upon the approach of pistons 51 of second cylinder 55 to a position directly before the opening of the opening ports of gate valves 53 due to the further rotation of pistons 51 as shown in FIG. 14(III), gas transfer valves 71, 72 in conduits 69, 70 are opened and simultaneously discharge valves 63, 64 connected to compressed gas accumulating reservoir 60 are closed, the residual compressed gases left within compression chambers C of second cylinder 55 transfering into compression chambers C of first cylinder 54 through conduits 69, 70. Therefore, since the gas pressures in compression chambers C of second cylinder 55 decrease, the pressure on the side surfaces of gate valves 53 decreases so that the shifting frictional resistance between gate valve casings 57 and gate valves 53 is decreased, making high speed operation easy. The residual compressed gases transfered from compression chambers C of second cylinder 55 into compression chambers C of first cylinder 54 raise the pressure in compression chambers C of first cylinder 54 so that the total compression efficiency of both first and second cylinder 54 and 55 is increased.

When pistons 50, 51 further rotate from the state shown in FIG. 14(III) gate valves 53 of second cylinder 55 are opened and pistons 51 pass through the opening ports of gate valve casings 57. After pistons 51 have passed through the opening ports of gate valves 53 these gate valves are closed immediately, and the compression stroke begins again. At this time first cylinder 54 is at an intermediate stage of the compression cycle, and upon further rotation of pistons 50, 51, pistons 50 of first cylinder 54 come close to gate valves 52 as shown in FIG. 14(IV). When the pressures in compression chambers C of first cylinder 54 exceed a predetermined level discharge valves 61, 62 connected to compressed gas accumulating reservoir 60 are opened to cause the compressed gas to discharge into reservoir 60.

When pistons 50 of first cylinder 54 rotates further from the state shown in FIG. 14(IV) to that shown in FIG. 14($V_1$) (i.e. the state precisely corresponding to that of second cylinder 55 shown in FIG. 14(III)), discharge valves 61, 62 connected to compressed gas accumulating reservoir 60 are closed and simultaneously gas transfer valves 71, 72 in conduits 69, 70 are opened, the residual compressed gases left within compression chambers C of first cylinder 54 transfer into compression chambers C of second cylinder 55 through conduits 69, 70, revealing the same effects as stated above, but alternately between both compression chambers of first and second cylinders 54, 55, the residual compressed gases within compression chambers C of first cylinder 54 are similarly recovered into compression chambers C of second cylinder 55 this time.

When gate valves 52 of first cylinder 54 are opened pistons 50 pass through the opening ports of gate valve casings 56 as shown in FIG. 14($V_2$) to be returned to the condition shown in FIG. 14(I), the operational cycle so far stated being recommenced to repeat the cycle.

The compressed gases thus stored in compressed gas accumulating reservoir 60 at a predetermined level may be taken out to perform any desired work.

Next, FIGS. 15(I) to ($V_2$) are sequential diagrams showing one operational cycle of the fluid machine according to the present invention as applied to an internal combustion engine comprising an expander and an air compressor with two fluid machine units described above being used. In this engine a first unit $U_3$ as the expander and a second unit $U_4$ as the air compressor are arranged on a common rotor shaft to be driven in parallel, with the relative phase angles of pistons 82, 83 of first and second units $U_3$, $U_4$ being shifted in relation to each other by a predetermined adequate angle on the basis of the gate valves.

A compressed air accumulating reservoir 84 is provided between two units $U_3$, $U_4$, reservoir 84 being connected to suction valves 85, 86 of expander units $U_3$ and discharge valves 87, 88 of compressor unit $U_4$, while the expander unit $U_3$ and compressor unit $U_4$ are provided with suction ports 91*a*, 92*a* and discharge ports 91*b*, 92*b*, respectively, near valve casings 89, 90 of the former and the latter, respectively. Branched from conduits 93, 94 which connect suction ports 91*a* of expander unit $U_3$ and discharge ports 92*b* of compressor unit $U_4$, respectively, are conduits 95, 96 which are in communication with compressed air accumulating reservoir 84 and connected to suction valves 85, 86, respectively. Also, branched from conduits 93, 94 are conduits 97, 98 which are in communication with reservoir 84 and connected to discharge valves 87, 88. Conduits 93, 94 are also connected to compressed air transfer valves 99, 100, respectively.

Figure 15:
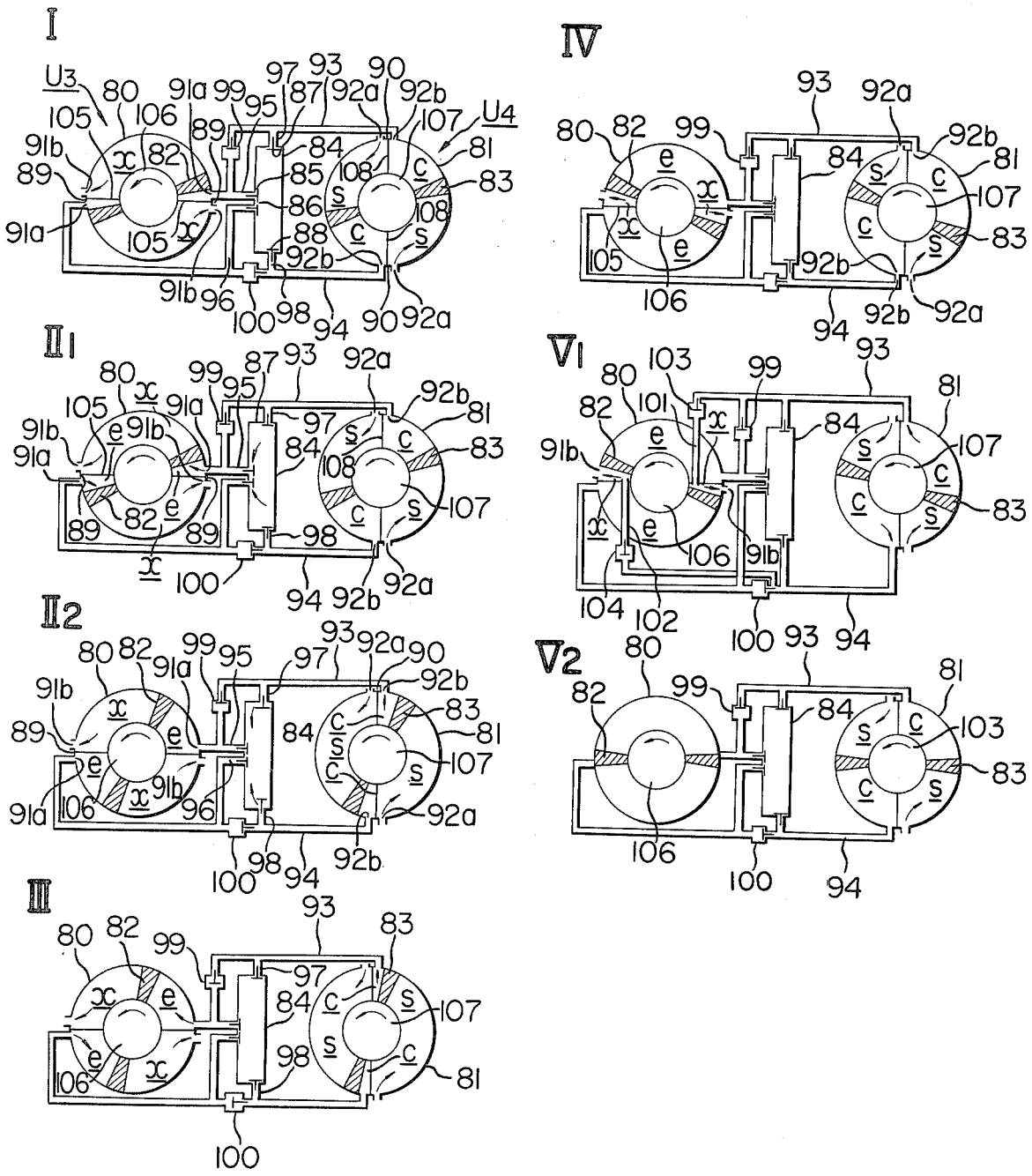
FIG. 15 (I, II1, II2, III, IV, VI, V2) consists of sequential diagrams to show one complete operational cycle of an internal combustion engine comprising two fluid machine units shown in FIGS. 1 to 4, one for an air compressor and another for an expander.

Although not shown in the drawings other than FIG. 15($V_1$) there are provided further conduits 101, 102 as shown in FIG. 15($V_1$), one end of each of which is connected to a port near discharge ports 91*b* of expander unit $U_3$, respectively, the other ends of which are connected to discharge ports 92*b* of compressor unit $U_4$, respectively, and valves 103, 104 are connected to conduits 101, 102, which are in communication with conduits 93, 94, respectively.

In the embodiment shown in FIG. 15 first unit $U_3$ operates as an expander of an internal combustion engine, while second unit $U_4$ operates as an air compressor which supplies compressed air into expander unit $U_3$ through compressed air accumulating reservoir 84. Rotors 106, 107 of both units $U_3$ and $U_4$ rotate counterclockwise. In FIG. 15(I) pistons 82 of expander unit $U_3$ are shown in the state directly after they have passed through gate valves 105, the latter being shown in the state of having completed closure of the cylinder chamber, i.e. in the state directly before the explosion cycle of expander unit $U_3$, while compressor unit $U_4$ is in the intermediate stage of the compression cycle.

In the condition where the pistons 82, 83 have moved on further as shown in FIG. 15($II_1$) suction valves 85, 86 connected to compressed air accumulating reservoir 84 are opened to force the compressed air therein to be sucked into explosion chambers e of expander unit $U_3$ via conduits 95, 96. At this time, in the case of a diesel engine, fuels are injected into explosion chambers e through nozzles (not shown) to be ignited, and in the case of a gasoline engine, ignitable gases being fuel mixed with air are injected into explosion chambers e through a carburetor (not shown) provided near suction ports 91*a* into explosion chambers e to be ignited by an ignition means. Driving power from the explosion pressure generated in explosion chambers e urges pistons 82, 83 to the state shown in FIG. 15($II_2$).

Exhaust chambers x formed between gate valves 105 and the front faces of pistons 82 of expander unit $U_3$ as viewed in their moving direction effect the exhaust cycle. Pistons 83 of compressor unit $U_4$ approach gate valves 108 compressing the air within compression chambers C, and when the air pressure within them exceeds a predetermined level discharge valves 87, 88 are opened so that the compressed air is stored in compressed air accumulating reservoir 84. At this state, suction valves 85, 86 of expander unit $U_3$ are kept closed when, as shown in FIG. 15(III), pistons 83 of compressor unit $U_4$ draw nearer to gate valves 108, discharge valves 87, 88 are closed and simultaneously transfer valves 99, 100 are opened, and the residual compressed air left in compression chambers C of compressor unit $U_4$ enters the explosion chamber of expander unit $U_3$, accelerating pistons 82. At the same time, the opening and closing operation of gate valves 108 of compressor unit $U_4$ is made easy in the same manner as abovementioned in connection with the compressor shown in FIG. 14.

While gate valves 108 of compressor unit $U_4$ are opened pistons 83 pass through gate valve casings 90, and when they enter the intermediate stage of the compression cycle as shown in FIG. 15 (IV) via the beginning of the compression cycle, pistons 82 of expander unit $U_3$ approach gate valves 105 to perform the exhaust cycle. At this time, scavenging valves 103, 104 are momentarily opened, as shown in FIG. 15($V_1$) and the air under substantially high pressure within compressor unit $U_3$ at the intermediate stage of compression cycle flows into exhaust chambers x of expander unit $U_3$ to effect the scavenging of chambers x.

Directly after the completion of scavenging, gate valves 105 of expander unit $U_3$ are opened, pistons 82 passing through opening ports of gate valve casings 89 as shown in FIG. 15($V_2$) to be returned to the state shown in FIG. 15(I). Thus, one full operational cycle is completed, and the new cycle commences to repeat the operational sequence as described above.

Although in FIG. 15 the discharge valves, suction valves, transfer valves, scavenging valves, etc. are assumed to be located at respective portions as shown in the drawing they are located there only for the convenience of the explanation of their operations, and in reality their locations should be selected to be optimum from the points of view of performance and manufacturing, and so on.

Moreover, although in the embodiments shown in FIGS. 14 and 15 the respective units have two pistons and two gate valves, the number of pistons is not limited to two, and, indeed should be selected as appropriate to the specific purpose in hand.

It is to be understood that although only certain preferred embodiments of the present invention have been illustrated and described, various changes may be made in the form, details, arrangement and proportion of the parts of the rotary piston type fluid machine units themselves as well as the machines consisting thereof, and therefore, the units may be applicable to various machines other than those exemplified above in various forms without departing from the scope of the invention which consists of the matter shown and described herein and set forth in the appended claims.

What is claimed is:

1. A rotary piston type fluid machine comprising a plurality of rotary piston type fluid machine units singly or in combination, each of said fluid machine units comprising a doughnut type ring-shaped annular cylinder with an annular slit being formed in the wall around the inner periphery so as to lie in a plane containing the annular center line of said cylinder, a rotor rotatively mounted to said cylinder centrally with its peripheral portion being sealingly and shiftably received in said slit, a rotor shaft means connected to said rotor centrally to transmit or take out power thereto or therefrom, one or more rotary pistons secured to the peripheral surface of said rotor and adapted to be shifted within said cylinder, and one or more gate valves provided in said cylinder so as to retractably protrude into said cylinder across it and adapted to partition chambers within said cylinder between them and said rotary pistons when protruding into said cylinder, said gate valve and said rotary pistons being operated in synchronization with each other and being shifted in relation to each other, said fluid machine units being arranged in a side-by-side relationship with said rotors being connected together by a common rotor shaft, and with said fluid machine units each being respectively operated as a compressor with the relative process phases of said rotary pistons of said fluid machine units being shifted in relation to each other by a predetermined process phase angle between said units, a compressed gas accumulating reservoir, said fluid machine units being adapted to supply in alternation gases compressed by them to said compressed gas accumulating reservoir, compressed gas transfer valves cooperating with said rotary pistons and said gas accumulating reservoir to convey the remaining compressed gas of one of said compressors just before the final compression process into another of said compressors which is under an intermediate compression process, whereby the total compression efficiency of said compressors is considerably improved.

2. A rotary piston type fluid machine as claimed in claim 1 wherein said rotary piston is provided with pressure sealing ring means and oil retaining ring means in the outer periphery which undertakes a relative shifting motion between the inner surface of said cylinder.

3. A rotary piston type fluid machine as claimed in claim 1 wherein said gate valve is slidably mounted within a gate valve casing secured to said cylinder so as to vertically cross said annular center line of said cylinder and having a substantially rectangular cross-section with the confronting side walls being sealingly partially embedded into said cylinder, said side walls being provided with an opening port in the portion within said cylinder which has a cross-section corresponding to that of the inside of said cylinder so that said gate valve can periodically sealingly close or open said opening ports in said side walls of said gate valve casing in synchronization with the movement of said rotary pistons when it is moved reciprocally.

4. A rotary piston type fluid machine as claimed in claim 1 wherein a number of said rotary pistons are arranged at equi-angular intervals around said outer peripheral surface of said rotor and a corresponding number of said gate valve casings with gate valves are arranged at equi-angular intervals in said cylinders.

5. A rotary piston type fluid machine as claimed in claim 1 wherein said rotor shaft is rotatively supported by bearing means each formed in a pair of cover plates, respectively, said cover plates being arranged in a confronting relationship centrally of said cylinder with their outer peripheries being sealingly connected to the inward peripheral wall of said cylinder, whereby at least the peripheral confronting surfaces of said cover plates are spaced by a distance substantially the same as the thickness of said rotor.

6. A rotary piston type fluid machine as claimed in claim 1 wherein a cross-sectional shape of the inner surface of said cylinder and the outer surface of the rotary piston may be any one of a circle, ellipse or rectangle, and wherein the shape of the pieces comprising the whole of said cylinder may be any simple symmetric shape dividing the whole cylinder into two or more pieces being cut vertically to the direction of the rotor shaft and each section being symmetrical so as to enable said machine to be produced as easily as possible.

7. A rotary piston type fluid machine as claimed in claim 1 wherein said gate valve is rotatively mounted within a gate valve casing secured to said cylinder so as to vertically cross said annular center line of said cylinder and having substantially a flat cylindrical shape with the confronting side walls being sealingly partially embedded into said cylinder, said side walls each being provided with an opening port in the portion within said cylinder which has a cross-section corresponding to that of the inside of said cylinder, and said gate valve is rotatively mounted to said side walls so as to periodically sealingly close or open said opening ports in synchronization with the movement of said rotary pistons.

* * * * *